US005487719A

United States Patent [19]

Houston et al.

[11] Patent Number: 5,487,719

[45] Date of Patent: Jan. 30, 1996

[54] CENTRIFUGE ROTOR ASSEMBLY

[75] Inventors: James M. Houston, Evergreen; Kenneth Biggio, Littleton, both of Colo.

[73] Assignee: Denver Instrument Company, Arvada, Colo.

[21] Appl. No.: 181,417

[22] Filed: Jan. 14, 1994

[51] Int. Cl.[6] ..... B04B 5/02

[52] U.S. Cl. ..... 494/16; 494/38

[58] Field of Search ..... 403/325–328; 494/16–18, 38, 60; 436/45, 177; 422/101

[56] References Cited

U.S. PATENT DOCUMENTS

| | | | |
|---|---|---|---|
| 2,704,681 | 3/1955 | Fischer | 403/326 |
| 3,366,320 | 1/1968 | Cho | 494/16 |
| 3,819,111 | 6/1974 | Romanouskas | 494/16 |
| 4,360,151 | 11/1982 | Cowell et al. . | |
| 4,579,476 | 4/1986 | Post | 403/328 |
| 4,675,106 | 6/1987 | Schoendorfer et al. . | |
| 4,790,543 | 12/1988 | Wittmeyer et al. . | |
| 4,822,231 | 4/1989 | Taylor | 494/16 |
| 4,832,679 | 5/1989 | Bader | 494/16 |
| 5,054,386 | 10/1991 | San Juan . | |
| 5,114,572 | 5/1992 | Hunter et al. . | |
| 5,172,361 | 12/1992 | Urushibata et al. . | |
| 5,193,084 | 3/1993 | Christiaens . | |
| 5,242,370 | 9/1993 | Silver et al. | 494/11 |
| 5,344,380 | 9/1994 | Chern | 494/16 |

FOREIGN PATENT DOCUMENTS

| | | | |
|---|---|---|---|
| 0043196A1 | 1/1982 | European Pat. Off. . | |
| 7529675 | 2/1976 | Germany . | |
| 3334655 | 4/1985 | Germany | 494/16 |
| 1588373 | 4/1981 | United Kingdom . | |
| 2107223 | 4/1983 | United Kingdom . | |
| 2233584 | 1/1991 | United Kingdom . | |

*Primary Examiner*—Stephen F. Gerrity
*Assistant Examiner*—Terrence R. Till
*Attorney, Agent, or Firm*—Finnegan, Henderson, Farabow, Garrett & Dunner

[57] ABSTRACT

A rotor assembly for use in a centrifuge is provided including a rotor body having a plurality of apertures for holding fluid containers. An impervious cover fits tightly on the rotor body to provide a seal for the rotor to prevent the escape of any sample from the rotor. Further, a mechanical connection system permits the rotor to be connected to and disconnected from a drive motor while the cover is sealing the rotor.

19 Claims, 5 Drawing Sheets

CENTRIFUGE ROTOR ASSEMBLY

BACKGROUND OF THE INVENTION

1. Field of the Invention

The present invention relates to rotor assemblies for use in centrifuges. In particular, the invention relates to rotor assemblies in which the samples held by the rotor are completely sealed within the rotor, when the rotor is inserted into or removed from the centrifuge.

2. Description of the Related Art

A centrifuge subjects fluid and other samples to centrifugal force in order to separate substances of different density. Typically, a centrifuge includes a rotor with a plurality of holes for receiving samples in test tubes. The rotor, with the test tubes, is placed into the centrifuge over the extended drive shaft of the centrifuge's motor. In conventional centrifuges, the top central portion of the rotor must remain open, so that the user can mechanically fix the rotor to the motor shaft. For instance, a nail, a thumb screw, or similar connector must be hand-operated to secure the rotor in place.

Often, research or clinical laboratories use centrifuges during experimentation with and testing of hazardous materials, including radioactive or biological samples. Of important concern is the possible escape of such materials and resultant contamination of a centrifuge operator or laboratory environment.

In conventional systems, containment of the samples is provided by sealed test tubes. In some systems, covers or caps are also placed over the individual test tubes, after they are placed in the rotor. Such systems present problems associated with safety, as well as convenience and efficiency.

SUMMARY OF THE INVENTION

It is to be understood that the foregoing general description and the following detailed description are exemplary and explanatory and are intended to provide further explanation of the invention as claimed.

Accordingly, the present invention is directed to centrifuge rotor assemblies in which the rotor can be inserted into and removed from a centrifuge while the contents of the rotor are completely sealed, in order to prevent any leakage of test samples, should one or more test tubes fail.

To achieve these and other advantages and in accordance with the purpose of the invention, as embodied and broadly described herein, the invention comprises a rotor assembly for use in a centrifuge. The rotor assembly includes a rotor, a plurality of apertures within the wall for holding fluid containers, and a groove surrounding the wall. A flexible cover large enough to cover all of the apertures engages the groove and provides a seal to prevent the escape of any sample from the rotor. In addition, the invention provides a means for connecting the rotor to a centrifuge drive motor, while the cover is in sealed engagement with the rotor. The invention further includes retaining means for holding the rotor in place during the centrifuge operation.

DESCRIPTION OF THE DRAWINGS

The accompanying drawings are included to provide a further understanding of the invention and are incorporated in and constitute a part of this specification, illustrate preferred embodiments of the invention, and, together with a description, serve to explain the principles of the invention.

DESCRIPTION OF THE PREFERRED EMBODIMENTS

Figure 1:
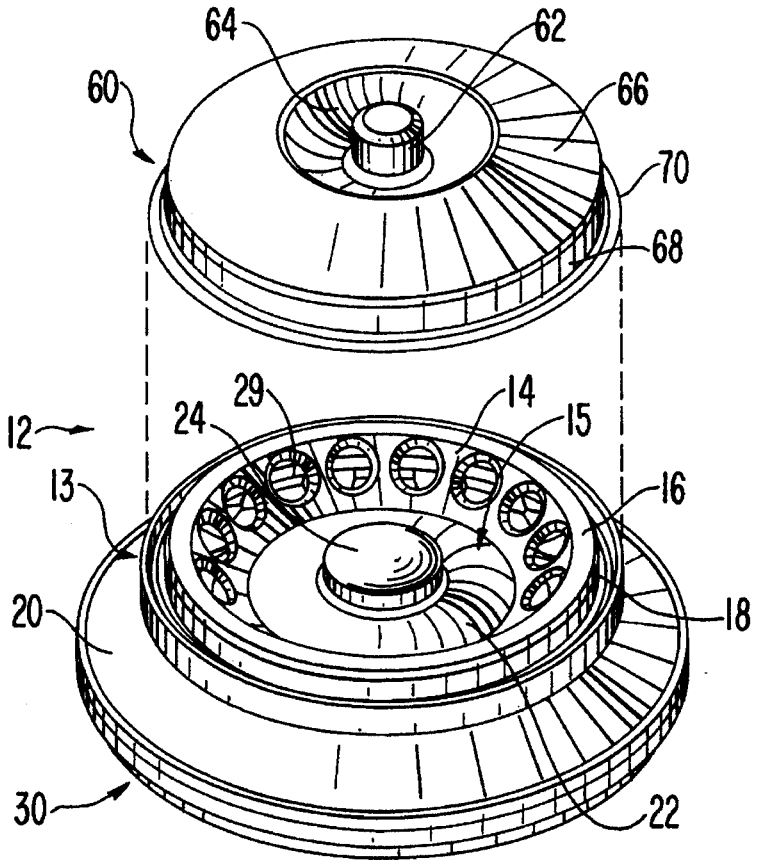
FIG. 1 is an exploded perspective view of the rotor body and cover of a centrifuge rotor assembly according to the present invention.

Reference will be made in detail to the present preferred embodiments of the invention, examples of which are illustrated in the accompanying drawings. Like reference numerals refer to like parts in the various figures of the drawings.

As will become apparent as the present invention is described in more detail, the rotor assembly of the present invention includes three major components. The first is a rotor body for receiving a plurality of test tubes or similar containers of samples to be centrifuged. The second is a cover for fitting over all of the test tubes or containers in forming a seal between the cover and the rotor body, once the test tubes are placed into the rotor body. The third is a drive mechanism for permitting a user of the rotor assembly to connect the combination of the rotor body, test tubes, and seal cover to the centrifuge motor while the cover engages the rotor body and creates a seal over the test tubes.

Figure 2:
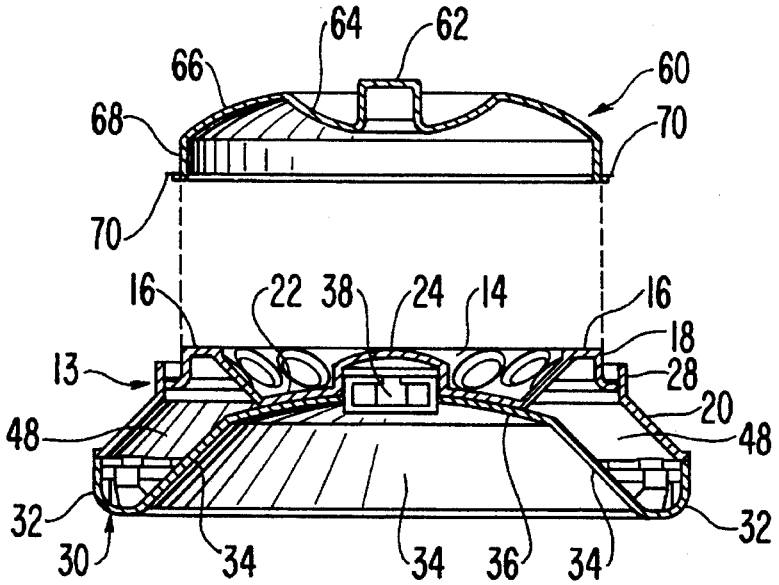
FIG. 2 is an cross-sectional view of the components of the rotor assembly shown in FIG. 1.

As can be seen best in FIG. 2, the rotor body is in the preferred embodiment formed of top and bottom molded parts that are then ultrasonically welded together to form a unitary rotor body. In the preferred embodiment, parts are made from plastic and are molded components. However, the rotor body can be made from a variety of materials and in a variety of ways, as will be apparent to persons skilled in the art after reviewing this disclosure.

The rotor body 12 for use in a centrifuge includes a top portion 13 having an outwardly and upwardly angled inner wall 14, as shown in FIG. 1. The inner wall 14 bounds a central bowl-like cavity 15. Preferably, the wall 14 is of a frustoconical shape and is formed at an approximately 45° angle to the rotor axis of rotation.

Figure 3:
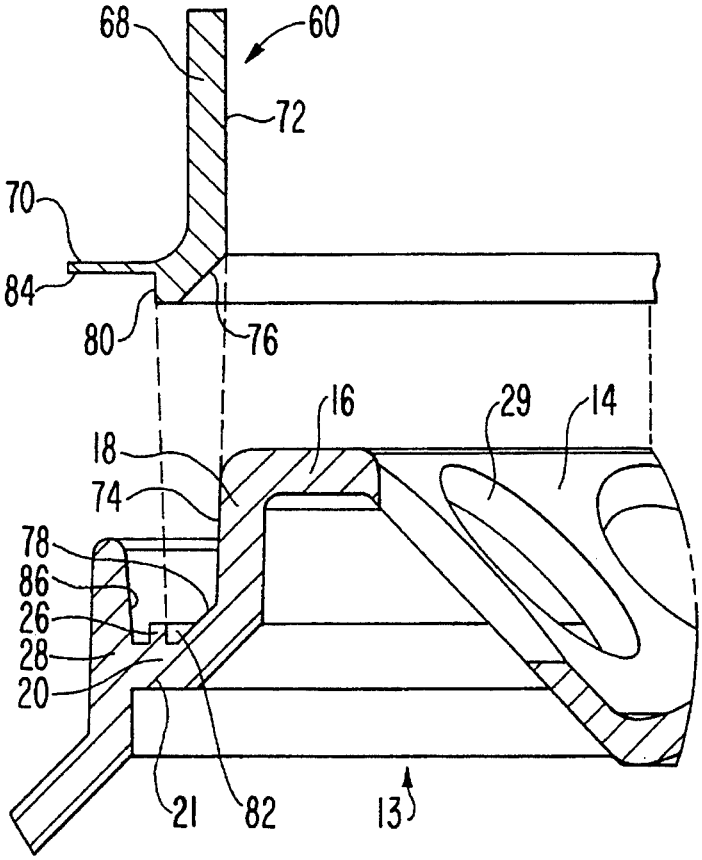
FIG. 3 is an enlarged, fragmentary component cross-sectional view, showing the relationship of cover and rotor parts.

An annular top wall 16 is joined to the upper periphery of wall 14, as shown most clearly in FIGS. 2 and 3. The annular top wall 16 is further joined at its outer periphery to a cylindrical sidewall 18. The lower end of wall 18 connects to a top exterior frustoconical wall 20 which extends outwardly and downwardly.

The base of the wall 14 joins an upper annular web 22, as shown in FIGS. 1 and 2, which forms a generally flat central surface. As shown in FIG. 1, the center of the rotor body includes a central hub cover 24.

As shown most clearly in FIG. 3, the top exterior frustoconical wall 20 extends as a radial wall portion 21. The rotor body includes a vertical, annular lip 28 that is opposite wall 18. An annular ridge 26 is formed on the top of the radial wall portion 21 and lies between the lip 28 and the frustoconical wall 20. As will be explained in more detail below, the radial wall 21, wall 18, lip 28, and ridge 26 form a groove into which a cover is inserted and form surfaces which cooperate with the cover to form a tight, leakproof seal.

Further, the top rotor portion 13 includes a plurality of countersunk apertures 29 in the inner wall 14, as shown most clearly in FIG. 1. The apertures 29 are angularly spaced uniformly throughout the circumference of the inner wall 14. As is generally known in the art, test tubes and similar sample containers are ultimately inserted into these apertures, directly or indirectly. As will be explained hereinafter, in the preferred embodiment, tubular inserts, which are first inserted in the apertures 29 to seal apertures 29, hold fluid containers containing fluid samples.

As embodied herein and as shown in FIG. 2, the rotor body 12 further includes a bottom portion 30 having a curved bottom wall 32 joined at the base of the top exterior wall 20. A bottom exterior frustoconical wall 34 joins wall 32 at the bottom of the rotor body 12. The wall 34 extends upwardly and inwardly and in the preferred embodiment is substantially parallel to the top exterior wall 20. As shown, these walls combine to form a space into which test tubes can be inserted.

The rotor bottom portion 30 further includes a bottom annular web 36 joining with the upper end of wall 34. The upper surface of the bottom annular web 36 is preferably in contact with the lower surface of the top annular web 22, as shown in FIG. 2. At the inner periphery of the bottom annular web 36, a central drive hub 38 joins the web 36. As will be described, this hub can be selectively connected with the motor of the centrifuge. The hub cover 24 overlies the drive hub 38, thus, shielding a user from the mechanical components that connect the rotor body and housing.

Figure 4:
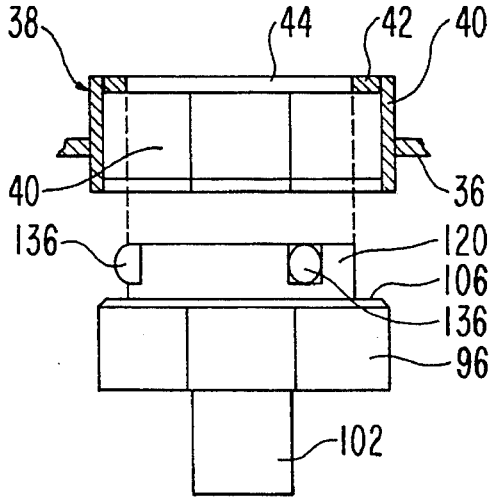
FIG. 4 is a side view of a rotor snap mechanism in relation to a portion of the rotor body in cross-section, according to the present invention.

As shown in FIG. 4, drive hub 38 includes a polygonal sidewall 40. An upper annular wall 42 joins the top end of the sidewall 40. The upper wall 42 defines a circular hole 44 at the top of hub 38, and wall 42 forms a shoulder around that circular hole. The sidewall 40 defines a multifaceted opening 46 just below the hole 44. Preferably, the opening 46 is octagon-shaped and has a larger effective diameter than the hole 44.

The top and bottom rotor portions 13 and 30 form an annular housing chamber 48, as shown in FIG. 2. Preferably, the top and bottom portions 13 and 30 are molded separately, and are then held together thru the use of detents. Preferably, the parts are secured by ultrasonic welding at the joints between the top exterior wall 20 and the curved bottom wall 32. Alternatively, the rotor portions 13 and 30 may be machined from a solid material.

Figure 5:
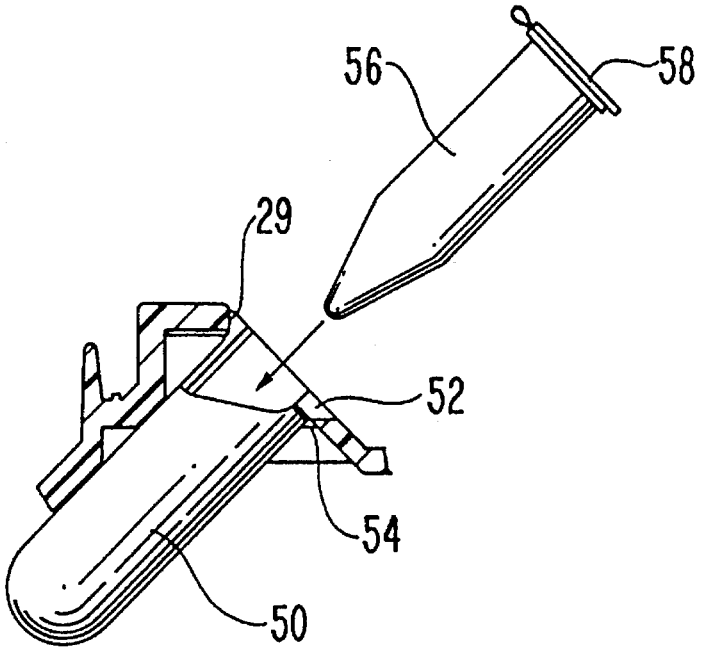
FIG. 5 is an enlarged partial cross-sectional view of a portion of a rotor body, illustrating how a sample container is held by the rotor body of the present invention.

The rotor assembly of the present invention preferably includes tubes 50 that can be inserted into the apertures 29 of the rotor body 12, as shown in FIG. 5. The tubes 50, when inserted into the rotor body, extend into the housing chamber 48. Each tube 50 preferably includes a flared supporting lip 52, which nests in a corresponding countersunk aperture 29. The rotor body 12 includes a peripheral rib 54 adjacent to the base of the flared lip 52 near the upper edge of the tube 50. The rib 54 holds the tube 50 in place tightly against the aperture 29, in order to form a seal. This insures that any fluid accidentally spilled into the cavity 15 does not escape through apertures 29 and into the housing chamber 48.

Further, test tubes in the form of fluid containers 56 are preferably inserted within each tube 50, as shown in FIG. 5. The fluid containers 56 contain samples to be centrifuged. Caps 58 seal the fluid sample within the fluid containers 56. The fluid containers 56 are angled outward at an approximately 45° angle from the rotor axis of rotation. When centrifuging, this angled placement allows for the separation of substances of different densities within the fluid sample. As is known, substances of higher density will collect towards the bottom portion of fluid container 56.

According to the present invention, the rotor assembly further includes a cover 60, as shown in FIGS. 1 and 2. As shown, this cover is sufficiently large to cover all of the apertures formed in the rotor body, and it is shaped and designed to form a tight seal with the rotor body. Preferably, the cover 60 is formed of a transparent plastic material. This permits visual inspection of the rotor contents after centrifugation to determine if there has been accidental leakage of fluid or breakage of a fluid container 56.

As embodied herein, the cover 60 includes a knob-shaped central grip 62 for easily putting the cover 60 onto and taking the cover 60 off of the rotor top portion 13. A bowl-shaped web 64 is joined to the grip 62 at the base of the grip 62. A downward sloping dome-like wall 66 extends from the upper periphery of the web 64 to an outer depending cylindrical sidewall 68. As most clearly shown in FIG. 3, the cover includes an outer wiper blade 70 that extends about the full circumference of the cover 60 and joins with the base of the sidewall 68. Preferably, the wiper blade 70 extends perpendicular to the rotor axis of rotation and is comprised of a thin flexible plastic material approximately 1/100 of an inch thick.

Figure 6:
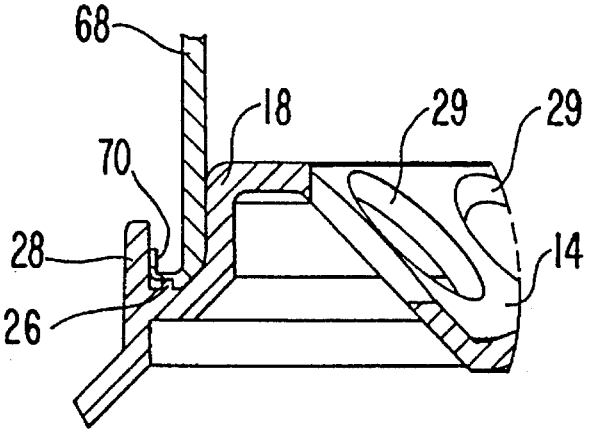
FIG. 6 is a cross-sectional view showing the cover and rotor parts of FIG. 3 in a closed condition.

As shown in FIGS. 3 and 6, the inner surface 72 of the cover sidewall 68 is of a diameter to fit in sealed engagement with the outer surface 74 of the cylindrical sidewall 18 in the rotor top portion 13. Further, a flared bottom surface 76 on the cover 60 complements the outer surface 78 of the top exterior wall 20. A cylindrical outer surface 80 at the bottom of the cover wall 68 is dimensioned to fit snugly within an inner cylindrical surface 82 on the vertical ridge 26. In addition, a portion of the lower surface 84 of the wiper blade 70 engages the inner surface 86 of the vertical lip 28. As shown in FIG. 6, the wiper blade 70 bends upward when the cover 60 is placed onto the rotor top portion 13. Thus, a tight and complete seal is provided between the cover 60 and the top portion of the rotor 13.

Figure 10:
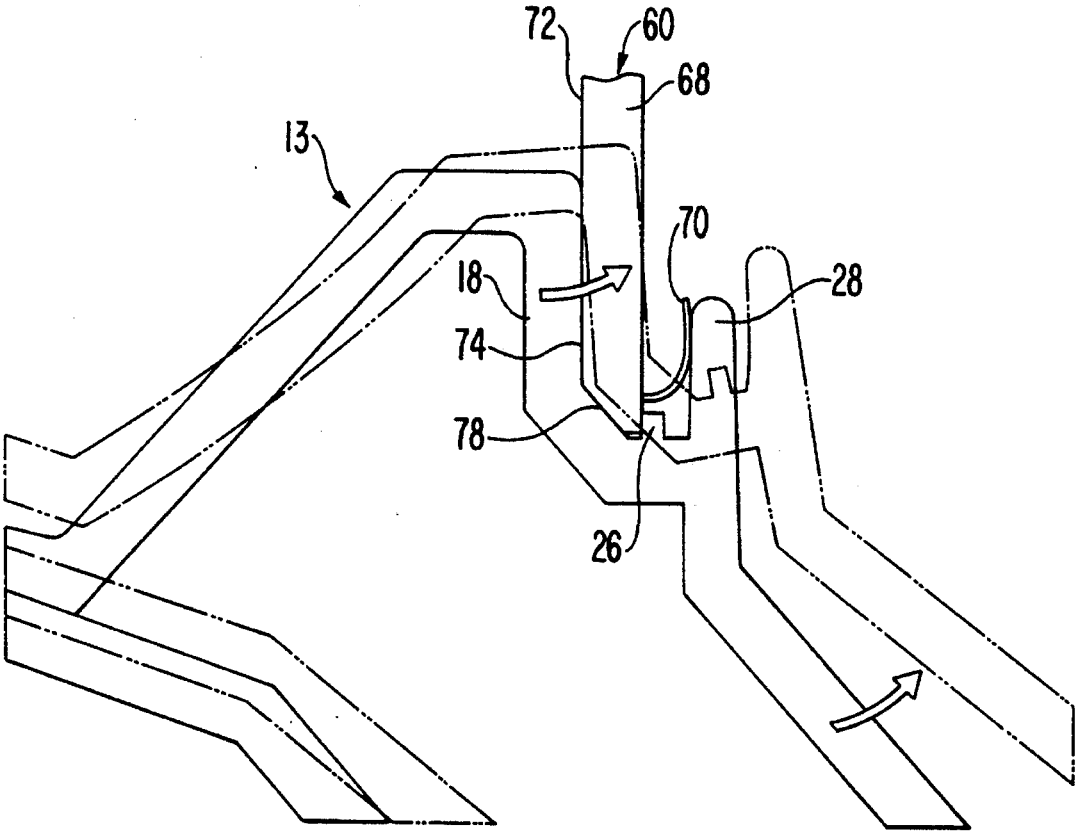
FIG. 10 is an enlarged cross-sectional view of a portion of the rotor, showing, in an exaggerated illustration, the flex of the rotor when under rotation.

Under static conditions, the nesting of the cover 60 into the rotor top portion 13 provides a tight seal for the rotor 12. An even tighter seal between the cover 60 and the rotor top portion 13 results when the rotor 12 is subject to rotation. As depicted by the thick arrows in FIG. 10, under centrifuge speeds, the rotor top portion 13 will flex outwardly due to centrifugal forces. The solid lines in FIG. 10 represent the top rotor portion 13 under static conditions, while the broken lines depict the position of the rotor top portion 13 under centrifuging speeds in a very exaggerated illustration. As the top portion 13 strains outwardly, the surface 74 of the sidewall 18 exerts pressure against the inner surface 72 of the cover wall 68 to develop hoop stress in the wall. This pressure and the resultant hoop stress combine at the surface 72 to form a very tight seal between the cover wall 68 and the sidewall 18 of the rotor 12. In addition, the vertical ridge 26 pinches the bottom of the cover wall 68 as the rotor top portion 13 yields outwardly. The inner cylindrical surface 82 of the ridge 26 will press against the outer surface 80 of the cover 60. This forces the bottom portion of the cover wall 68 against the surface 78 of the rotor, providing an even stronger closure. Lastly, the vertical lip 28 develops an overcut orientation relative to the wiper blade 70 of the cover 60 to provide yet a more effective seal. The strengthened seal that results during centrifuging prevents the escape of contaminants or other fluids from the cavity 15 in the event of accidental fluid leakage or fluid container failure.

The rotor 12, according to the present invention, further includes a means for connecting the rotor 12 to a drive motor. The connection mechanism transmits torque from the motor drive shaft to the rotor while also supporting the rotor against axial release from the motor drive shaft. As will be explained below, this connection means includes the drive hub 38 formed in the rotor body 12 and a corresponding drive member to be fixed to the motor. The connection mechanism is designed to permit the rotor body and cover to be connected to and disconnected from the motor, while the rotor body and the cover are in a sealed relationship. Preferably, the connection mechanism also provides a mechanical snap assembly which will tend to ensure that the rotor body remains temporarily fixed to the motor, when the rotor is rotated.

Figure 7:
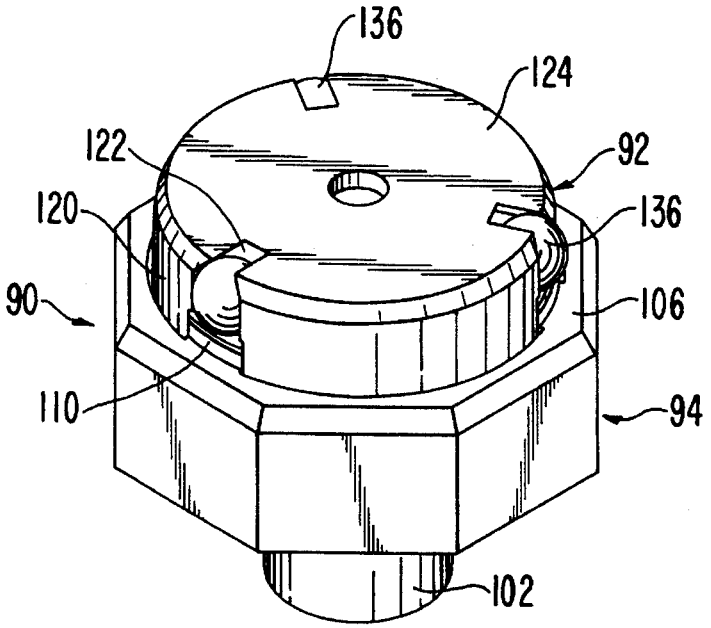
FIG. 7 is a perspective view of a rotor snap mechanism according to the present invention.
Figure 8:
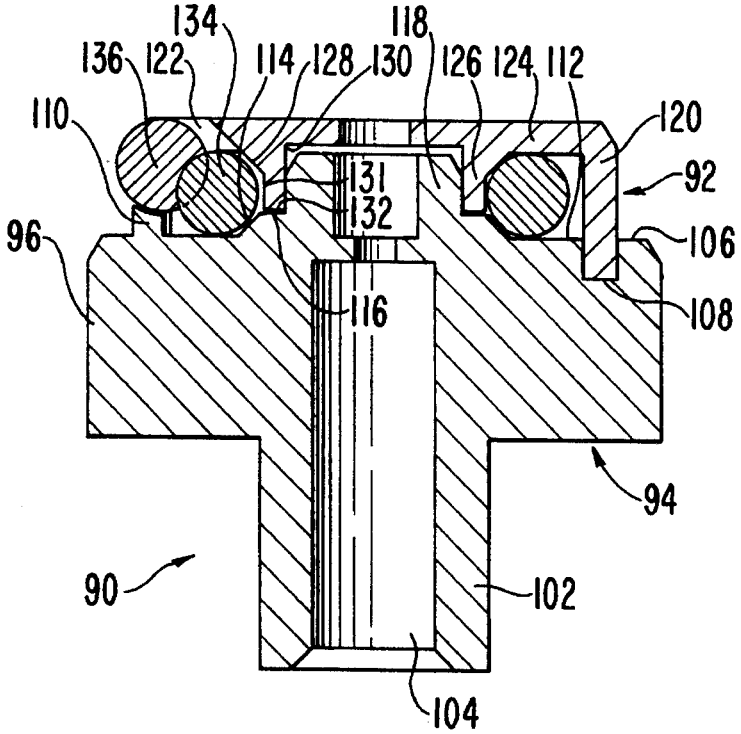
FIG. 8 is a cross-sectional view of the rotor snap mechanism shown in FIG. 7.

In the preferred embodiment, the connector means includes a rotor snap mechanism 90 having an upper portion 92 and a bottom portion 94, as shown in FIGS. 7 and 8. For ease of manufacture, the upper and bottom portions 92 and 94 are preferably molded separately, snapped together, and ultrasonically welded together.

Figure 9:
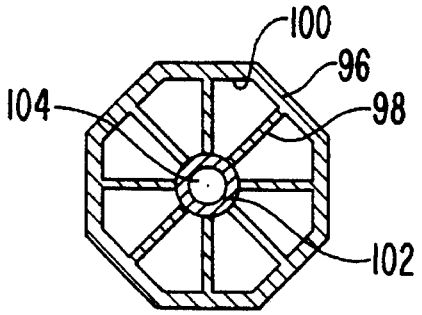
FIG. 9 is a bottom end view of the rotor snap mechanism shown in FIG. 7.

The bottom portion 94 of the rotor snap mechanism 90 includes an outer polygon-shaped sidewall 96, as most clearly shown in FIG. 9. The sidewall 96 is shaped to correspond to the drive hub 38 in rotor 12 and in the embodiment illustrated is octagon-shaped to complement the sidewall 40 of the central drive hub 38, as shown in FIG. 4. In the preferred embodiment, the bottom portion 94 further includes a plurality of radial spokes 98 joined to the inner surface 100 of the outer sidewall 96. Preferably, as shown in FIG. 9, the bottom portion includes eight spokes 98 spaced at approximately 45° intervals. The outer end of each spoke 98 joins with the center of one side of the octagon-shaped sidewall 96.

A cylindrical bushing 102 is centrally located within the bottom portion 94. The bushing 102 joins the spokes 98 at inner end of the spokes 98. The bushing 102 includes a central bore opening 104, as shown in FIGS. 8 and 9. The bore opening 104 is permanently fixed to a centrifuge drive motor shaft to transmit torque to the rotor 12 during operation. The drive motor may be press fit into the bore opening 104 thru the use of knurls or fins on the motor drive shaft.

The bottom portion 94 of the rotor snap mechanism 90 further includes a shoulder 106 joining with the upper end of the outer sidewall 96. As shown in FIG. 4, when the rotor 12 is inserted onto the rotor snap mechanism 90, the wall 42 at the top of the drive hub 38 rests on the shoulder 106. The shoulder 106 supports the weight of the rotor 12 during the centrifuging operation.

Further, as shown in FIG. 8, the bottom portion 94 of the rotor snap mechanism 90 has an annular moat-shaped channel 108 joining with the inner periphery of the shoulder 106. The channel 108 is preferably circular. A plurality of equally spaced stubs 110 are within the channel 108, as shown most clearly in FIGS. 7 and 8. The stubs 110 extend upwardly and interrupt the channel 108. Preferably, the rotor snap mechanism 90 includes three stubs 110 spaced 120° from each other.

As shown in FIG. 8, an upper radial floor 112 joins the with the inner periphery of the channel 108. In turn, a frustoconical surface 114 joins with the inner periphery of the floor 112. Surface 114 extends upwardly and inwardly. Further, an inner radial surface 116 connects to the upper end of the surface 114. A cylindrical inner wall 118 joins the inner periphery of the radial surface 116.

The upper portion 92 of the rotor snap mechanism 90 includes a cylindrical sidewall 120. Preferably, the sidewall 120 is circular with an outer diameter slightly less than the diameter of the hole 44 of the drive hub 38, as shown in FIG. 4. In addition, the sidewall 120 has a width slightly less than the width of the channel 108, as shown in FIG. 8. The upper portion 92 further includes a plurality of equally spaced openings 122, as shown most clearly in FIGS. 7 and 8. As embodied herein, three openings 122 are spaced 120° apart from one another. The number of openings 122 corresponds to the number of stubs 110. This results because, when the upper portion 92 joins the bottom portion 94, the sidewall 120 inserts within the channel 108. The openings 122 align with the stubs 110, as shown in FIG. 7. Preferably, the width of each opening 122 approximates the length of each stub 110.

The upper portion 92 further includes radial ceiling surface 124 joining at the upper end of the sidewall 120. A cylindrical boss 126 having a flared upper surface 128, an inner surface 130, an outer surface 131, and a bottom surface 132, depends from the ceiling surface 124. When the upper and bottom portions 92 and 94 are connected, the inner surface 130 engages the outer surface of the inner wall 118, while the bottom surface 132 complements the radial surface 116.

The rotor snap mechanism 90, according to the present invention, further includes an elastomeric O-ring 134, as shown in FIG. 8. The O-ring 134 sets on the floor 112. Further, the rotor snap mechanism 90 includes a plurality of ball bearings 136 contained within the openings 122 and resting on the stubs 110. As embodied herein, three ball bearings 136 are spaced 120° apart in each opening 122.

When the rotor 12 is placed onto the rotor snap mechanism 90, the sidewall 120 enters the hole 44. The ball bearings 136 are forced inward and pushed against the O-ring 134. The cylindrical boss 126 restrains the O-ring 134 as the O-ring 134 presses against the outer surface 131 and the flared upper surface 128. Once through the hole 44, the ball bearings 136 are forced back to their static position by the O-ring 134. The rotor 12 then rests on the shoulder 106 of the rotor snap mechanism 90. The ball bearings 136 secure the rotor 12 in place.

While a preferred connection mechanism has been illustrated and described in great detail, other connection systems can be used within the scope and spirit of the present invention. Such systems can include different shaped female and male members to form the connection, as well as a variety of spring biased systems to temporarily lock the rotor body to the motor.

In operation, fluid samples are placed in the fluid containers 56 and caps 58 are closed. The fluid containers are then placed into the tubes 50. Next, the cover 60 is placed onto the rotor top portion 13 and over the cavity 15. The cover 60 is pressed downward so that it nests within the top portion 13 to create a tight seal, as hereinabove explained.

The rotor 12 is then inserted into a centrifuge and placed over the rotor snap mechanism 90 so that the ball bearings 136 hold the rotor 12 in place. Typically, the centrifuge body will include a hinged lid, which is then closed over the rotor 12 and locked down.

During centrifuging, the seal between the cover 60 and the rotor 12 strengthens due to centrifugal forces, as explained above. In the event of fluid container breakage, fluid will not leak from the cavity 15 to the outside of the rotor 12.

After centrifuging, the rotor 12, including the cover 60, is removed from the rotor snap mechanism 90. Upon inspection, if fluid container failure has occurred, the rotor 12 can be disposed of as necessary, for example, by placing it in an autoclave for sterilization.

This rotor design allows for placement in and removal from a centrifuge without removing the cover 60. The rotor 12 can be safely withdrawn preventing contamination to an operator from potentially hazardous materials, for example, biological or radioactive materials.

It will be apparent to those skilled in the art that various modifications and variations can be made in the support packs of the present invention without departing from the spirit or scope of the invention. Thus, it is intended that the present invention cover the modifications and variations of this invention provided they come within the scope of the appended claims and their equivalents.

What is claimed is:

1. A rotor assembly for use in a centrifuge having a drive motor, said rotor assembly comprising:

a rotor having a plurality of apertures for holding fluid containers and a circular groove surrounding said plurality of apertures, said groove including a substantially vertical inner sidewall and a substantially vertical ridge positioned outwardly of said inner sidewall;

an impervious cover that engages said groove and provides a seal to prevent the escape of fluid from said rotor, said cover including an outer substantially vertical surface which fits in sealed engagement with said ridge of said groove and an inner substantially vertical surface which fits in sealed engagement with said sidewall of said groove; and connection means for permitting the connection and disconnection of said rotor to the centrifuge drive motor while said cover is in the engaged position.

2. The rotor assembly of claim 1, wherein at least a portion of said cover is translucent.

3. The rotor assembly of claim 1, wherein at least a portion of said cover is transparent.

4. The rotor assembly of claim 1, wherein the connection means includes a male drive member for attachment to the drive shaft of the motor and a corresponding female aperture formed in the bottom of the rotor.

5. The rotor assembly of claim 1, wherein the connection means includes retaining means for ensuring engagement between the rotor and the connection means during centrifuge operation.

6. A rotor assembly for use in a centrifuge having a drive motor, said rotor assembly comprising:

a rotor having a plurality of apertures for holding fluid containers and a groove surrounding said plurality of apertures;

an impervious cover that engages said groove and provides a seal to prevent the escape of fluid from said rotor, wherein said groove includes an outer vertical lip and said cover includes a wiper blade engaging the inner surface of the outer vertical lip; and connection means for permitting the connection and disconnection of said rotor to the centrifuge drive motor while said cover is in the engaged position.

7. The rotor assembly of claim 6, wherein said outer vertical lip extends inward and overcuts said wiper blade when said rotor rotates.

8. The rotor assembly as claimed in claim 1, wherein said cover is formed of flexible material and said outer vertical surface of said cover presses against said vertical ridge when the rotor rotates.

9. The rotor assembly of claim 1, wherein said cover is transparent.

10. The rotor assembly of claim 1, wherein said cover includes a central grip for putting on and removing said cover.

11. The rotor assembly of claim 1, further including a plurality of tubular inserts inserted within said plurality of apertures for accepting a sample container.

12. The rotor assembly of claim 11, wherein each of said tubular inserts includes an outer rib surrounding a periphery of an upper edge of said tube, said rib positioned under said aperture to firmly position said tubular insert in said aperture.

13. The rotor assembly of claim 11, wherein each of said tubular inserts includes a support lip engaging said aperture to seal said aperture.

14. A rotor assembly for use in a centrifuge having a drive motor, said rotor assembly comprising:

a rotor having a plurality of apertures for holding fluid containers and a groove surrounding said plurality of apertures;

an impervious cover that engages said groove and provides a seal to prevent the escape of fluid from said rotor;

connection means for permitting the connection and disconnection of said rotor to the centrifuge drive motor while said cover is in the engaged position, the connection means including retaining means for ensuring engagement between the rotor and the connection means during centrifuge operation, said retaining means including biased members that retain said rotor when the rotor is in engagement with the motor, said retaining means including a plurality of ball bearings surrounding an O-ring.

15. The rotor assembly of claim 14, wherein the periphery of said shoulder is octagonal.

16. A rotor assembly for use in a centrifuge having a drive motor, said rotor assembly comprising:

a rotor body having a plurality of apertures for holding fluid containers;

an impervious cover to fit together on said rotor body, said cover being sufficiently large to fit over all of said apertures and being designed to conform to the shape of the rotor body when the cover is fitted over said apertures, thereby forming a seal at the interface of the cover and rotor when the cover is placed in a sealed position; and a mechanical connection system that permits the rotor to be selectively connected to and disconnected from the drive motor while said cover is in the sealed position, the mechanical connection system including a mechanical snap assembly retaining the rotor body to the drive motor during operation of the centrifuge, said mechanical snap assembly including a central drive hub in the bottom of the rotor body that engages a rotor snap mechanism permanently fixed to the drive motor shaft, said rotor snap mechanism including a plurality of ball bearings surrounding an O-ring.

17. The rotor assembly of claim 14, wherein said retaining means further includes a shoulder on which said rotor rests.

18. The rotor assembly of claim 8, wherein said groove includes an outer vertical lip and said cover includes a wiper blade engaging the inner surface of the outer vertical lip.

19. The rotor assembly of claim 18, wherein said outer vertical lip extends inward and overcuts said wiper blade when said rotor rotates.

* * * * *